US009976208B2

(12) United States Patent
Aruga et al.

(10) Patent No.: US 9,976,208 B2
(45) Date of Patent: May 22, 2018

(54) COPPER ALLOY WITH HIGH STRENGTH AND EXCELLENT PROCESSABILITY IN BENDING AND PROCESS FOR PRODUCING COPPER ALLOY SHEET

(71) Applicant: Kobe Steel, Ltd., Kobe-Shi (JP)

(72) Inventors: Yasuhiro Aruga, Kobe (JP); Katsura Kajihara, Kobe (JP); Takeshi Kudo, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 558 days.

(21) Appl. No.: 14/583,894

(22) Filed: Dec. 29, 2014

(65) Prior Publication Data

US 2015/0107726 A1 Apr. 23, 2015

Related U.S. Application Data

(62) Division of application No. 11/994,136, filed as application No. PCT/JP2006/312252 on Jun. 19, 2006, now abandoned.

(30) Foreign Application Priority Data

Jul. 7, 2005 (JP) ..... 2005-199022
Dec. 27, 2005 (JP) ..... 2005-375454

(51) Int. Cl.

| | |
|---|---|
| ***C22C 9/00*** | (2006.01) |
| ***C22F 1/08*** | (2006.01) |
| ***B22D 11/00*** | (2006.01) |
| ***C22C 1/06*** | (2006.01) |
| ***C22C 9/02*** | (2006.01) |
| ***C22C 9/04*** | (2006.01) |
| ***C22C 9/06*** | (2006.01) |
| ***B22D 21/02*** | (2006.01) |
| ***C22C 9/05*** | (2006.01) |
| *B21B 3/00* | (2006.01) |

(52) U.S. Cl.

CPC ..... *C22F 1/08* (2013.01); *B22D 11/004* (2013.01); *B22D 21/025* (2013.01); *C22C 1/06* (2013.01); *C22C 9/00* (2013.01); *C22C 9/02* (2013.01); *C22C 9/04* (2013.01); *C22C 9/05* (2013.01); *C22C 9/06* (2013.01); *B21B 2003/005* (2013.01)

(58) Field of Classification Search

CPC ..... C22C 9/00; C22C 9/06; C22C 9/02; C22F 1/08

USPC ..... 148/432, 434, 433, 414, 681, 685

See application file for complete search history.

(56) References Cited

U.S. PATENT DOCUMENTS

| | | | | |
|---|---|---|---|---|
| 2,401,075 | A * | 5/1946 | Humes | B22D 7/00 164/126 |
| 4,605,532 | A * | 8/1986 | Knorr | C22C 9/00 148/412 |
| 4,749,548 | A | 6/1988 | Akutsu et al. | |
| 5,248,351 | A | 9/1993 | Kubozono et al. | |
| 5,334,346 | A * | 8/1994 | Kim | C22C 9/06 420/485 |
| 2002/0044881 | A1 | 4/2002 | Breedis et al. | |
| 2005/0092404 | A1 | 5/2005 | Aruga et al. | |
| 2005/0161126 | A1 | 7/2005 | Aruga et al. | |
| 2006/0137773 | A1 | 6/2006 | Aruga et al. | |
| 2007/0148032 | A1 | 6/2007 | Aruga et al. | |

FOREIGN PATENT DOCUMENTS

| | | |
|---|---|---|
| EP | 0 769 563 | 4/1997 |
| GB | 473970 | 10/1937 |
| JP | 2-111829 | 4/1990 |
| JP | 6-235035 | 8/1994 |
| JP | 10-265873 | 10/1998 |
| JP | 2000-104131 | 4/2000 |
| JP | 2000-328157 | 11/2000 |
| JP | 2001-279347 | 10/2001 |
| JP | 2002-294364 | 10/2002 |
| JP | 2002-339028 | 11/2002 |
| JP | 2005-133185 | 5/2005 |
| JP | 2005-133186 | 5/2005 |
| JP | 2005-206891 | 8/2005 |
| WO | 99/05331 A1 | 2/1999 |

OTHER PUBLICATIONS

European Search Report dated Sep. 19, 2012, in European Patent Application No. 11008840.8 filed Jun. 19, 2006.

Aruga, et al., "Estimation of Effect of Dispersoids on Softening Behavior of Cu—Fe—P Alloys by the Extracted Residue Analysis", Journal of the JRICu, vol. 43, No. 1, pp. 74-78 (2004).

Aruga, et al., "Effect of Dispersoids on Softening Behavior in Cu—Fe—P Alloys for Lead Frames", Kobe Steel Engineering Reports, vol. 55, No. 1, pp. 37-40 (2005).

* cited by examiner

*Primary Examiner* — Erin B Saad

(74) *Attorney, Agent, or Firm* — Oblon, McClelland, Maier & Neustadt, L.L.P.

(57) ABSTRACT

The present invention provides a Cu—Fe—P alloy which has a high strength, high conductivity and superior bending workability. The copper alloy comprises 0.01 to 1.0% Fe, 0.01 to 0.4% P, 0.1 to 1.0% Mg, and the remainder Cu and unavoidable impurities. The size of oxides and precipitates including Mg in the copper alloy is controlled so that the ratio of the amount of Mg measured by a specified measurement method in the extracted residue by a specified extracted residue method to the Mg content in said copper alloy is 60% or less, thus endowing the alloy with a high strength and superior bending workability.

11 Claims, No Drawings

COPPER ALLOY WITH HIGH STRENGTH AND EXCELLENT PROCESSABILITY IN BENDING AND PROCESS FOR PRODUCING COPPER ALLOY SHEET

This application is a divisional of U.S. application Ser. No. 11/994,136 filed Dec. 28, 2007, now abandoned, which is a National Stage of PCT/JP2006/312252 filed Jun. 19, 2006, both of which are incorporated herein by reference. This application also claims the benefit of JP 2005-199022 filed Jul. 7, 2005 and JP 2005-375454 filed Dec. 27, 2005.

TECHNICAL FIELD

The present invention relates to a copper alloy which has a high strength, a high electrical conductivity and superior bending workability, e.g., a copper alloy suitable for use as electrical or electronic part materials in household appliances, semiconductor parts such as IC lead frames for semiconductor devices or the like, printed wiring boards or the like, copper alloying element plate strips used in mechanical parts such as opening-and-closing parts, bus bars, terminals, connectors and the like. Furthermore, the present invention also relates to a method for manufacturing such a copper alloy.

BACKGROUND ART

Cu—Fe—P alloys which contain Fe and P have been commonly employed in the past as copper alloys in the various applications described above, beginning with semiconductor IC lead frames and the like. Examples of such Cu—Fe—P alloys include copper alloys that contain 0.05 to 0.15% Fe and 0.025 to 0.040% P (C19210 alloy) and copper alloys that contain 2.1 to 2.6% Fe, 0.015 to 0.15% P and 0.05 to 0.20% Zn (CDA194 alloy). If Fe or an inter-metallic compound such as Fe—P or the like is precipitated in a copper matrix phase, such Cu—Fe—P alloys are superior even among copper alloys in terms of strength, electrical conductivity and thermal conductivity; accordingly, these alloys are commonly used as international standard alloys.

In recent years, with the expanded use of Cu—Fe—P alloys, and the reduced weight, increased thinness and more compact size of electrical and electronic devices, there has been a demand for even greater strength and conductivity, and superior bending workability, in these copper alloys as well. In regard to such bending workability, there has been a demand for characteristics that allow severe bending such as U-bending, 90-degree bending after notching and the like.

In regard to these requirements, it has long been known that the bending workability can be improved to some extent by making the crystal grains finer, or by controlling the disperse state of the crystallized/precipitated matter (see patent documents 1-6 below).

Furthermore, in the case of Cu—Fe—P alloys, control of the aggregate structure has also been proposed as a means of improving various characteristics such as bending workability and the like. In more concrete terms, it has been proposed that the ratio of the X-ray diffraction intensity I(200) of the plane (200) to the X-ray diffraction intensity I(220) of the plane (220) in copper alloy plates, i.e., I(200)/I(220), be 0.5 to 10, that the orientation density of the cubic orientation, i.e., D(cubic orientation), be 1 to 50, or that the ratio of the orientation density D(cubic orientation) of the cubic orientation to the orientation density D(S orientation) of the S orientation, i.e., D(cubic orientation)/D(S orientation), be 0.1 to 5 (see patent document 7 below).

Furthermore, it has been proposed that the ratio of the sum of the X-ray diffraction intensity I(200) of the plane (200) and the X-ray diffraction intensity I(311) of the plane (311) to the X-ray diffraction intensity I(220) of the plane (220) in copper alloy plates, i.e., [I(200)+I(311)]/I(220), be 0.4 or greater (see patent document 8 below).

Patent document 1: Japanese Patent Application Laid-Open No. 6-235035 (entire text)

Patent document 2: Japanese Patent Application Laid-Open No. 2001-279347 (entire text)

Patent document 3: Japanese Patent Application Laid-Open No. 2005-133185 (entire text)

Patent document 4: Japanese Patent Application Laid-Open No. 10-265873 (entire text)

Patent document 5: Japanese Patent Application Laid-Open No. 2000-104131 (entire text)

Patent document 6: Japanese Patent Application Laid-Open No. 2005-133186 (entire text)

Patent document 7: Japanese Patent Application Laid-Open No. 2002-339028 (paragraphs 0020 to 0030)

Patent document 8: Japanese Patent Application Laid-Open No. 2000-328157 (embodiments)

DISCLOSURE OF THE INVENTION

Problems to be Solved by the Invention

The addition of solid-solution reinforcing elements such as Sn or Mg, and an increase in the amount of work-hardening obtained by strong working effected by increasing the working ratio of cold rolling, which are conventional means of obtaining high-strength copper alloys, are inevitably accompanied by a deterioration in bending workability, so that it is difficult achieve both the necessary strength and the necessary bending workability at the same time. However, an increase in work hardening by such strong working involving cold rolling has become essential in order to obtain high-strength Cu—Fe—P alloys with a tensile strength of 400 MPa or greater that can handle the above-mentioned decrease in size and weight seen in electrical and electronic parts in recent years.

However, in the case of such high-strength Cu—Fe—P alloys, the bending workability cannot be sufficiently improved with respect to severe bending such as the above-mentioned U-bending, 90-degree bending after notching or the like merely by using structure control means such as the finer grain size, control of the disperse state of the crystallized/precipitated matter or the like described in the above-mentioned patent documents 1-6 or the aggregated structure control means described in the abovementioned patent documents 7, 8.

The present invention was devised in order to solve such problems; it is an object of the present invention to provide a Cu—Fe—P alloy which has both a high strength and superior bending workability.

Means to Solve the Problems

In order to achieve this object, in a first aspect of the present invention, there is provided a copper alloy having a high strength and superior bending workability, comprising 0.01 to 1.0% by mass of Fe, 0.01 to 0.4% by mass of P, 0.1 to 1.0% by mass of Mg, and remainder Cu and unavoidable impurities, wherein:

the size of oxides and precipitates including Mg in the copper alloy is controlled so that the ratio of the amount of Mg described below in the extracted residue by the extracted residue method described below using a filter with an opening size of 0.1 μm to the Mg content in said copper alloy is 60% or less;

said extracted residue method is a method in which 10 g of said copper alloy is immersed in 300 ml of a methanol solution with a 10 mass % concentration of ammonium acetate, constant-current electrolysis is performed at a current density of 10 mA/cm$^2$ using this copper alloy as an anode and using platinum as a cathode, said solution in which only the matrix of this copper alloy is dissolved is subjected to suction filtration using a polycarbonate type membrane filter with an opening size of 0.1 μm, and the residue is separated and extracted on this filter; and said amount of Mg in said extracted residue is the amount that is determined by ICP following dissolution of the residue on said filter by means of a solution in which aqua regia and water are mixed at a ratio of 1 to 1.

In the grain size measured by a crystal orientation analysis method in which an electron back scattering pattern system is mounted on a field emission scanning electron microscope, the mean grain size described below is 6.5 μm or less, and the standard deviation of the mean grain size described below is 1.5 μm or less.

When n indicates the number of crystal grains measured and x indicates the grain size values measured, the mean grain size is expressed as $(\Sigma x)/n$, and the standard deviation of the mean grain size is expressed as $[n\Sigma x^2-(\Sigma x)^2]/[n/(n-1)^{1/2}]$.

In a second aspect of the present invention, there is provided a copper alloy having a high strength and superior bending workability, respectively containing 0.01 to 3.0% by mass of Fe, 0.01 to 0.4% by mass of P and 0.1 to 1.0% by mass of Mg, and remainder Cu and unavoidable impurities, wherein in the grain size measured by a crystal orientation analysis method in which an electron back scattering pattern system is mounted on a field emission scanning electron microscope, the mean grain size described below is 6.5 μm or less, and the standard deviation of the mean grain size described below is 1.5 μm or less.

When n indicates the number of crystal grains measured and x indicates the grain size values measured, the mean grain size is expressed as $(\Sigma x)/n$, and the standard deviation of the mean grain size is expressed as $[n\Sigma x^2-(\Sigma x)^2]/[n/(n-1)^{1/2}]$.

In the present invention, in order to improve the bending workability, the ratio of small-angle grain boundaries, which are grain boundaries between crystal grains in which the difference in crystal orientation is small, i.e., 5 to 15°, as measured by the abovementioned crystal orientation analysis method in the abovementioned copper alloy structure, is 4% to 30%, taken as the ratio the total crystal grain boundary length of these small-angle grain boundaries to the total length of the crystal grain boundaries in which the difference in crystal orientation is 5 to 180°.

In the present invention, Ni or Co, or both, may further be contained at the rate of 0.01 to 1.0% in order to improve the bending workability.

Furthermore, it is desirable that the abovementioned copper alloy further contain 0.005 to 3.0% Zn in order to improve the thermal peeling resistance of Sn plating or solder, and thus suppress thermal peeling.

Furthermore, in cases where it is desired to improve the strength, it is desirable that the abovementioned copper alloy further contain 0.01 to 5.0% Sn.

It is desirable that a alloy plate contain one or two elements selected from a set comprising Mn and Ca at the total rate of 0.0001 to 1.0% by mass.

It is desirable that the abovementioned copper alloy plate further contain one or more elements selected from a set comprising Zr, Ag, Cr, Cd, Be, Ti, Co, Ni, Au and Pt at the total rate of 0.001 to 1.0% by mass.

It is desirable that the content of Mn, Ca, Zr, Ag, Cr, Cd, Be, Ti, Co, Ni, Au and Pt in the abovementioned copper alloy be set at 1.0 mass % or less in terms of the total content of these elements.

It is desirable that the content of Hf, Th, Li, Na, K, Sr, Pd, W, S, Si, C, Nb, Al, V, Y, Mo, Pb, In, Ga, Ge, As, Sb, Bi, Te, B and mischmetal be set at 0.1 mass % or less in terms of the total content of these elements.

In a first aspect of the method of the present invention, there is provided a method for manufacturing a plate of the copper alloy which has such a high strength and superior bending workability, in which a copper alloy plate is obtained by casting, hot rolling, cold rolling and annealing, wherein the required time from the completion of the addition of the alloying elements in a melting furnace to the initiation of casting is set at 1200 seconds or less, and wherein the required time from the ejection of a ingot from the heating furnace to the completion of hot rolling is set at 1200 seconds or less.

In a second aspect of the method of the present invention, there is provided a method for manufacturing a plate of the copper alloy which has such a high strength and superior bending workability, in which a copper alloy plate is obtained by a process including casting, hot rolling, cold rolling, annealing and cold rolling, wherein the temperature upon the completion of hot rolling is set at 550° C. to 850° C., the subsequent cold rolling rate is set at 70 to 98%, the mean heating rate in the subsequent annealing is set at 50° C./s or greater, the mean cooling rate following the annealing is set at 100° C./s or greater, and the cold rolling rate in the subsequent final cold rolling is set in the range of 10 to 30%.

Effect of the Invention

A prerequisite of the present invention is that the strength of Cu—Fe—P alloys is improved by further adding Mg to form Cu—Mg—P—Fe alloys. Furthermore, if Mg is simply included in the alloy, the strength is improved, but the bending workability is caused to deteriorate.

In order to improve the strength of a Cu—Mg—P—Fe alloy, it is effective to make the size of the precipitates containing Mg very fine, and to deposit large amounts of this substance. For this reason, it is necessary that the amount of Mg dissolved in the Cu matrix as a solid solution prior to annealing be large.

However, in Cu—Mg—P—Fe alloys, most of the added Mg is not dissolved in solid solution in the Cu matrix. In actuality, most of the Mg is contained in oxides and crystal deposits produced during dissolution and casting, and in coarse deposits produced from the even heating of the ingot to hot rolling.

These coarse Mg oxides and precipitates, i.e., coarse Mg compounds, not only do not contribute to an improvement in strength, but constitute starting points for failure, and cause a drop in the bending workability. On the other hand, fine Mg compounds which have a small size (particle diameter) contribute to an improvement in strength, and do not cause any drop in bending workability.

Accordingly, in the present invention, fine oxides and precipitates containing Mg (Mg compounds), which are effective in improving the strength, are caused to remain in large amounts in accordance with the amount of added Mg (Mg contained in the alloy). At the same time, the quantity of oxides and precipitates (Mg compounds) containing coarse Mg is controlled to a small amount, so that a copper alloy having a high strength and superior bending workability in good balance is obtained.

In the present invention, the strength is improved by further adding Mg of a Cu—Fe—P alloy, and, in order to prevent a deterioration in the bending workability, the crystal grains of the copper alloy composition are made finer, and the variation in the individual grain size values is suppressed. Specifically, coarse crystal grains are excluded from the copper alloy composition, and the individual grain size values are made as uniformly fine as possible.

The following is set as a measure or standard for this reduction in the grain size and variation in the grain size: namely, in the abovementioned crystal orientation analysis method in which a electron back scattering pattern system is mounted on an field emission scanning electron microscope, the mean grain size mentioned below is 6.5 μm or less, and the standard deviation of the mean grain size mentioned below is 1.5 μm or less. As a result, in the present invention, a copper alloy in which a high strength and superior bending workability are present in a well-balance manner can be obtained.

BEST MODE FOR CARRYING OUT THE INVENTION

First Embodiment (Composition of Copper Alloy)

First, the chemical composition in the Cu—Mg—P—Fe alloy of the present invention that is used to satisfy the requirements for the necessary strength and conductivity, and for the high bending workability and anti-stress relaxation characteristics needed in the various applications described above, will be described below.

In the present invention, in order to achieve a high strength, high conductivity and high bending workability, a basic composition is set which comprises a copper alloy respectively containing 0.01 to 1.0% by mass of Fe, 0.01 to 0.4% by mass of P, and 0.1 to 1.0% by mass of Mg, with the remainder comprising copper and unavoidable impurities. Furthermore, in the following descriptions of the respective elements, all descriptions of percentages are based on mass %.

In this basic composition, Ni or Co, or both, and Zn or Sn or both, may also be contained in the alloy in the ranges described below. Furthermore, other impurity elements may also be contained in ranges that have no deleterious effect on the characteristics of the alloy.

(Fe)

Fe forms fine deposits of the Fe—P type or the like, and is an element that is necessary in order to improve the strength and conductivity. In the case of a content of less than 0.01%, the fine precipitated particles are insufficient; accordingly, in order to manifest the effects described above in an effective manner, a content of 0.01% or greater is necessary. However, if the content exceeds 1.0%, this may lead to a coarsening of the precipitated particles, so that the strength and bending workability drop. Accordingly, the Fe content is set in the range of 0.01 to 1.0%.

(P)

In addition to having a de-acidifying effect, P forms fine deposits with Mg and Fe, and is an element that is necessary in order to improve the strength and conductivity of the copper alloy. In the case of a content of less than 0.01%, the fine precipitated particles are insufficient; accordingly, a content of 0.01% or greater is necessary. However, if this content exceeds 0.4%, the amount of Mg residue shows an excessive increase along with an increase in coarse Mg—P precipitated particles; consequently, the strength and bending workability drop, and there is also a drop in hot workability. Accordingly, the P content is set in the range of 0.01 to 0.4%.

(Mg)

Mg forms fine deposits with P, and is an element that is necessary in order to improve the strength and conductivity. In the case of a content of less than 0.1%, the fine precipitated particles of the present invention are insufficient; accordingly, a content of 1.0% or greater is required in order to manifest the abovementioned effects in an effective manner. However, if this content exceeds 1.0%, the precipitated particles are coarsened, and form starting points for failure, so that not only the strength but also the bending workability drops. Accordingly, the Mg content is set in the range of 0.1 to 1.0%.

(Ni, Co)

The copper alloy may also contain either Ni or Co, or both, at the rate of 0.01 to 1.0%. Like Mg, Ni and Co are dispersed in the copper alloy as fine particles of (Ni, Co)—P, (Ni, Co)—Fe—P or the like, and improve the strength and conductivity. A content of 0.01% or greater is required in order to manifest these effects in an effective manner. However, if the content exceeds 1.0%, this leads to a coarsening of the precipitated particles, so that not only the strength but also the bending workability drops. Accordingly, the content of Ni or Co, or both when these elements are selectively included is set in the range of 0.01 to 1.0%.

(Zn)

The copper alloy may further contain Zn or Sn, or both. Zn is used to join electronic parts; Sn improves the thermal peeling resistance of plating and solder, and is an element that is effective in controlling thermal peeling. In order to manifest such an effect in an effective manner, it is desirable that the content be 0.005% or greater. However, if this content is excessive, not only does this cause a deterioration in the flow spreading characteristics of the molten Sn and solder, but there is also a great resulting drop in the conductivity. Accordingly, considering the effect of Zn in improving the resistance to thermal peeling and the effect in lowering the conductivity, this element is selectively included in the range of 0.005 to 3.0 mass %, preferably 0.005 to 1.5 mass %.

(Sn)

Sn is dissolved in solid solution in the copper alloy, and contributes to an improvement in the strength. In order to manifest such an effect in an effective manner, it is desirable that the content be 0.01% or greater. However, if this content is excessive, this effect reaches saturation, and the conductivity is caused to drop greatly. Accordingly, considering the strength improving effect and conductivity lowering effect of Sn, this element is selectively included at the rate of 0.01 to 5.0 mass %, preferably 0.01 to 1.0 mass %.

(Other Elements)

Other elements are basically impurities, and it is desirable that the contents of these elements be as small as possible. For example, impurity elements such as Al, Cr, Ti, Be, V, Nb, Mo, W and the like tend to produce coarse crystals or deposits, and also tend to lower the conductivity. Accordingly, it is desirable that the total contents of these elements be as small as possible, i.e., 0.5 mass % or less. In addition, elements such as B, C, Na, S, Ca, As, Se, Cd, In, Sb, Pb, Bi, MM (mischmetal) and the like which are contained in the copper alloy in trace amounts also tend to lower the conductivity; accordingly, it is desirable that the total amount of these elements be kept to a minimal content of 0.1 mass % or less.

In more concrete terms, it is desirable that (1) the contents of Mn, Ca, Zr, Ag, Cr, Cd, Be, Ti, Co, Ni, Au and Pt be kept to 1.0 mass % or less in terms of the total amount of these elements, and that (2) the contents of Hf, Th, Li, Na, K, Sr, Pd, W, S, Si, C, Nb, Al, V, Y, Mo, Pb, In, Ga, Ge, As, Sb, Bi, Te, B and mischmetal be kept to 0.1 mass % or less in terms of the total amount of these elements.

(Mg Compounds)

In the present invention, as was described above, a copper alloy which has a high strength and a superior bending workability in a good balance is obtained by causing large amounts of fine Mg compounds which are effective in improving the strength to be present in large amounts, and controlling the amounts of coarse Mg compounds to small amounts.

Accordingly, it is necessary to stipulate, as MG compounds having a specific size in the structure of copper alloy, not only Mg deposits but also Mg oxides and crystal deposits, and the ratios of the amounts of these compounds. However, the sizes of the oxides and precipitates present in these copper alloys include various sizes ranging from the level of several tens of nanometers (several 0.01 μm length units) to several microns. Accordingly, it is extremely difficult to identify and stipulate these numerous types of Mg compounds directly.

Consequently, in the present invention, the amount of Mg contained in a coarse extracted residue (including coarse Mg deposits, Mg oxides and Mg crystal deposits) equal to or greater than a fixed size extracted and separated by the extracted residue method described below is stipulated as the amount of Mg used (consumed) in coarse Mg compounds. Then, the ratio of the amount of Mg in this coarse extracted residue to the Mg content in the copper alloy (amount of Mg contained as an alloy; hereafter also referred to as the "alloy Mg content") is determined, and this ratio is stipulated as the ratio of Mg used (consumed) in coarse Mg compounds to the alloy Mg content.

Furthermore, in the present invention, these coarse Mg compounds are stipulated as compounds exceeding 0.1 μm as the size of the openings in the filtration filter described below.

Furthermore, in the present invention, in order to obtain a copper alloy which has a high strength and a superior bending workability, the size of the Mg oxides and precipitates in the copper alloy is stipulated and controlled so that the ratio of the amount of Mg (described below) in the extracted residue that is extracted and separated on a filter with an opening size of 0.1 μm by the extracted residue method described below to the Mg content in the copper alloy is 60% or less. In cases where the amount of Mg (described below) in the extracted residue to the Mg content in the alloy exceeds 60%, the coarse oxides and precipitates of Mg (coarse Mg compounds) in the structure are increased, so that not only is the strength not improved, but the bending workability is also lowered.

(Extracted Residue Method)

Here, the extraction and separation method used for the oxides and precipitates containing Mg in the copper alloy will be described. The property of dissolving in ammonia in the presence of oxygen shown by the copper constituting the matrix of the copper alloy is utilized in order to dissolve only the copper and solid-solution elements (matrix) in the copper alloy, and in order to extract and separate the precipitates and oxides present in the copper alloy without dissolving and losing these substances. It is desirable to use an alcohol solution of ammonium acetate as the dissolving solution used for this purpose. Besides this, an alcohol solution of ammonium nitrate may also be used; in the present invention, however, an alcohol solution of ammonium acetate is used in order to obtain reproducibility in the measurements.

In concrete terms, the extracted residue is recovered by the following procedure using the following extraction-separation solution in the present invention. Specifically, 300 ml of a methanol solution of ammonium acetate (extraction-separation solution) in which the ammonium acetate concentration in the solution is 10 mass % is prepared, and 10 g of the copper alloy test sample is immersed in this solution. Then, constant-current electrolysis is performed at a current density of 10 mA/cm$^2$ using the copper alloy test sample as the anode, and using platinum as the cathode. In this case, after the matrix is dissolved while observing the dissolved state of the copper alloy test sample, the extraction-separation solution following the dissolution of the copper alloy is subjected to suction filtration using a polycarbonate membrane filter (opening size: 0.1 μm), and the residue remaining on the filter as undissolved matter is recovered.

(Amount of Abovementioned Mg in Extracted Residue)

The extracted residue of the undissolved matter on the abovementioned filter thus recovered is dissolved by means of a solution in which aqua regia and water are mixed at a 1 to 1 ratio ("aqua regia 1+1" solution); then, the abovementioned amount of Mg is determined by analysis using ICP (inductively coupled plasma) emission spectroscopy.

(Manufacturing Conditions)

Next, desirable manufacturing conditions for converting the structure of the copper alloy into the abovementioned structure stipulated by the present invention will be described below. The copper alloy of the present invention is basically a copper alloy plate; strips in which such a plate is slit in the lateral direction, and configurations in which such plate strips are rolled into a coil, are also included in the scope of the copper alloy of the present invention.

An optimal manufacturing method for manufacturing copper alloy plates which have a high strength and superior bending workability in the present invention is a method which is devised so that when a copper alloy plate is obtained by the casting, hot rolling, cold rolling and annealing of a copper alloy, the required time from the completion of the addition of the alloying elements in the melting furnace to the initiation of casting is 1200 seconds or less, and the required time from the ejection of the ingot from the ingot heating furnace to the completion of hot rolling is 1200 seconds or less.

In a general manufacturing process, a final (product) plate is obtained by the casting of a copper alloy melt adjusted to a specified composition, planing of the ingot, soaking, hot rolling and repeated cold rolling and annealing. Furthermore, the control of mechanical characteristics such as the strength level and the like is accomplished mainly by controlling the deposition of fine products having a size of 0.01 μm or less in accordance with the cold rolling conditions and annealing conditions. In this case, the diffusion of alloying elements such as Mg and the like into well-dispersed intermetallic compounds stabilizes the amount of Mg and the like in solid solution and amount of the fine product that is precipitated.

However, in such general manufacturing processes, even if large amounts of the abovementioned fine products are precipitated in accordance with the cold rolling conditions and annealing conditions from the hot rolling process on, it is extremely difficult to improve the strength and bending workability with good balance.

The reason for this is that most of the added Mg is taken up in oxides and crystal deposits generated during melting and casting, and in coarse deposits generated from the soaking of the ingot to the completion of hot rolling, so that the quantity of fine products that should be generated in accordance with the amount of Mg added is unexpectedly small. Furthermore, in cases where there are large amounts of coarse crystal deposits, the fine products that are precipitated in the cold rolling and annealing processes are trapped by these coarse products, so that there is a further decrease in the fine products that are independently present in the matrix. Accordingly, in the case of the abovementioned general manufacturing method, a sufficient strength and superior bending workability cannot be obtained in proportion to the large amount of Mg that is added.

Consequently, in the present invention, coarse Mg compounds are suppressed further upstream in the abovementioned manufacturing process. Specifically, in order to suppress coarse Mg compounds in particular, it is important (1) to control the time from the completion of the addition of the alloying elements in the melting furnace to the initiation of casting, and (2) to control the time from the ejection of the ingot from the heating furnace to the completion of hot rolling.

First of all, the melting/casting process itself can be accomplished using an ordinary method such as continuous casting, semi-continuous casting or the like. However, in the abovementioned (1) control of the time from the completion of the addition of the alloying elements in the melting furnace to the initiation of casting, it is desirable that the casting be performed within 1200 seconds, preferably 1100 seconds, from the time that the addition of the elements in the melting furnace is completed, and that the cooling/solidification rate be set at 0.1° C./sec or greater, preferably 0.2° C./sec or greater.

As a result, the production and growth/coarsening of oxides and crystal deposits containing Mg are suppressed, and these products can be finely dispersed. From the standpoint of suppressing the production of oxides containing Mg, it is even more desirable to perform vacuum melting and casting, or melting and casting performed in an atmosphere having a low oxygen partial pressure.

Conventionally, in order to achieve secure melting of a matrix alloy such as Cu—P or the like containing added elements, and uniform dispersion of the added elements in solid solution in the melt, and also because of the need for re-analysis following the follow-up addition of raw materials, a time of approximately 1500 seconds or greater to the initiation of casting has been required. However, it has been found that if such an amount of time is taken until the initiation of casting, the production/coarsening of oxides containing Mg is accelerated, and the yield of added elements is lowered.

In the manufacture of the copper alloy of the present invention, in order to avoid the production and coarsening of such oxides containing Mg, the required time from the completion of the addition of the alloying elements in the melting furnace to the initiation of casting is shortened to 1200 seconds or less, preferably 1100 seconds or less. Such a shortening of the time until casting can be achieved by predicting the composition following the follow-up addition of raw materials on the basis of past records of alloy melting, shortening the required time for re-analysis and the like.

Next, in the abovementioned (2) control of the time from the ejection of the ingot from the heating furnace to the completion of hot rolling, a waiting time to the initiation of hot rolling is generated for the ingot that is extracted from the heating furnace following the heating of the case ingot in this furnace. However, in order to manufacture the copper ingot of the present invention in which the coarsening of Mg compounds is suppressed, it is recommended to control the time from the abovementioned melting to the initiation of casting, and the cooling/solidification rate, and to control the required time (overall elapsed time) from the point in time at which the ingot is extracted from the heating furnace to the completion of hot rolling to 1200 seconds or less, preferably 1100 seconds or less.

Conventionally, such control of the time from the ejection of the ingot from the heating furnace to the completion of hot rolling has not been investigated, and a time exceeding 1500 seconds has generally been consumed by the transport of the ingot from the heating furnace to the hot rolling line, and lengthening of the hot rolling time accompanying an increase in the slab size aimed at improving productivity. However, it has been found that if such a long time is taken, coarse Mg type deposits such as Mg—P and the like are precipitated during this time, and that Mg and P are precipitated with the crystal deposits and oxides generated during melting and casting acting as nuclei. If such coarse Mg—P precipitated particles are increased, the amount of Mg residue also shows an excessive increase, so that the strength and bending workability drop, and so that the hot workability also drops.

In the manufacture of the alloy of the present invention, in order to avoid effects such as the abovementioned decrease in solid-solution Mg and solid-solution P, coarsening of the Mg compounds and the like, the total required time from the ejection of the ingot from the heating furnace to the completion of hot rolling is deliberately controlled to 1200 seconds or less as described above. Such time control can be accomplished by quickly transporting the ingot from the heating furnace to the hot rolling line, avoiding the use of large slabs that cause a lengthening of the hot rolling time, and using small slabs instead.

In regard to hot rolling, ordinary methods may be used; the entry side temperature of hot rolling is set at approximately 100 to 600° C., and the temperature upon completion of hot rolling is set at approximately 600 to 850° C. Subsequently, cold rolling and annealing are performed, so that a copper alloy plate or the like having the product plate thickness is formed. The annealing and cold rolling may be repeated in accordance with the final (product) plate thickness.

First Examples

Examples of the present invention will be described below. Various types of copper alloy thin plates comprising Cu—Mg—P—Fe alloys in which the states of Mg compounds in the structure were different were manufactured, and characteristics such as the strength, conductivity, bendability and the like were evaluated.

In concrete terms, copper alloys having the respective chemical compositions shown in Table 1 were respectively manufactured using a coreless furnace; then, ingots were manufactured by semi-continuous casting, thus producing ingots with a thickness of 70 mm×width of 200 mm×length of 500 mm. After the surfaces of the respective ingots were planed and heated, plates with a thickness of 16 mm were formed by hot rolling; then, these plates were rapidly cooled in water from a temperature of 650° C. or greater. Next, after the oxidation scale was removed, primary cold rolling (intermediate elongation) was performed. Following the planing of these plates, primary annealing was performed, and cold rolling was then performed. Next, after secondary annealing and final cold rolling were performed, low-temperature stress removal annealing was performed, thus producing copper alloy plate with a thickness of approximately 0.2 mm.

In this case, the state of the Mg compounds in the structure was controlled by varying the required time from the completion of the addition of the alloying elements in the melting furnace to the initiation of casting (described as the required time to the initiation of casting in Table 1), the cooling and solidification rate during casting, the heating furnace extraction temperature, the temperature upon completion of hot rolling, and the required time from the ejection of the ingot from the heating furnace to the initiation of hot rolling (described as the required time to the initiation of hot rolling in Table 1) as shown in Table 1.

Furthermore, in the respective alloys described in Table 1, the remaining composition besides the amount of elements described consisted of Cu. As elements other than those described in Table 1, the total content of Al, Cr, Ti, Be, V, Nb, Mo and W was 0.1 mass % or less. Furthermore, the total content of elements such as B, C, Na, S, Ca, As, Se, Cd, In, Sb, Pb, Bi, MM (mischmetal) and the like was also 0.1 mass % or less. Furthermore, in the contents of the respective elements shown in Table 1, "–" indicates a content that is below the detection limit.

10 g test samples for extracted residue measurement were collected from the respective copper alloy plates thus obtained, and the amount of Mg contained in the extracted residue extracted and separated by means of a mesh with an opening size of 0.1 μm using the method described above was determined by the abovementioned ICP emission spectroscopy analysis method. Then, the ratio (%) relative to the Mg content of the alloy was determined in each case. These results are shown in Table 2.

Furthermore, for all of the examples, test samples were cut out from the copper alloy plates obtained, and a tensile test, conductivity measurement and bending test were performed. These results are also shown in Table 2.

(Tensile Test)

In the tensile test, the tensile strength and 0.2% yield stress were measured at room temperature, a test rate of 10.0 mm/min and a GL value of 50 mm by means of a 5882 type Instron universal tester using JIS No. 13 B test samples.

(Measurement of Conductivity)

The conductivity of each copper alloy plate test sample was measured as follows: namely, a rectangular test sample with a width of 10 mm and a length of 300 mm was formed by milling, the electrical resistance was measured using a double bridge type resistance measuring instrument, and the conductivity was calculated by the mean cross-sectional area method.

(Bending Workability Evaluation Test)

The bending test of the copper alloy plate samples was performed according to the technical standard of the Japan Copper and Brass Association. The plate material was cut to a witch of 10 mm and a length of 30 mm, Good Way bending (with the bending axis perpendicular to the rolling direction) was performed at a bending radius of 0.05 mm, and the presence or absence of cracks in the bent portion was observed visually using a 50× optical microscope. Samples showing no cracks were evaluated as o, and samples showing cracks were evaluated as ×.

As is clear from Table 1, Examples 1 through 13 of the present invention, which are copper alloys within the composition range of the present invention, were manufactured under the following desirable conditions: namely, the required time from the completion of the addition of the alloying elements in the melting furnace to the initiation of casting was 1000 seconds or less, the cooling/solidification rate during casting was 0.5° C./sec or greater, and the required time from the ejection of the ingot from the heating furnace to the initiation of hot rolling was 1050 seconds or less. Furthermore, the heating furnace extraction temperature and the temperature upon the completion of hot rolling were both appropriate.

Accordingly, in Examples 1 through 13 of the present invention, the composition was controlled so that the ratio of the amount of Mg in the extracted residue extracted and separated by the abovementioned extracted residue method to the Mg content of the alloy was 60% or less, thus reducing the size of the oxides and precipitates of Mg in the copper alloy.

As a result, Examples 1 through 13 of the present invention showed a high strength and high conductivity, i.e., a yield stress of 400 MPa or greater, and a conductivity of 60% IACS or greater, and also showed a superior bending workability.

On the other hand, the copper alloy of Comparative Example 14 had an Mg content that was lower than the lower limit of 0.1%. As a result, the amount of Mg was too small in spite of the fact that the alloy was manufactured under desirable conditions similar to those of the abovementioned examples of the present invention, and in spite of the fact that the ratio of the amount of Mg in the extracted residue extracted and separated by the abovementioned extracted residue method to the Mg content of the alloy was 60% or less. Accordingly, although the bending workability was superior, the strength was low.

In the copper alloy of Comparative Example 15, the Mg content exceeded the upper limit of 1.0%. Consequently, the ratio of the amount of Mg in the extracted residue extracted and separated by the abovementioned extracted residue method to the Mg content of the alloy exceeded 60% in spite of the fact that the alloy was manufactured under desirable conditions similar to those of the abovementioned examples of the present invention. As a result, the strength was high, but the bending workability and conductivity were low.

In regard to the manufacturing method, the copper alloy of Comparative Example 16 was manufactured under desirable conditions, and the ratio of the amount of Mg in the extracted residue extracted and separated by the abovementioned extracted residue method to the Mg content of the alloy was 60% or less. Nevertheless, since the P content was less than the lower limit of 0.01%, the amount of P was too small, so that although the bending workability was superior, the strength was low.

In the copper alloy of Comparative Example 17, the P content exceeded the upper limit of 0.4%. Accordingly, along with an increase in coarse Mg—P precipitated particles, there was also an excessive increase in the residual amount of Mg, so that the strength, bending workability and conductivity were all low.

In the copper alloys of Comparative Examples 18 through 23, the compositions of the alloys are within the stipulated ranges; however, the respective manufacturing conditions depart from the desirable ranges. In Comparative Examples 18, 21 and 22, the required time from the completion of the addition of the alloying elements in the melting furnace to the initiation of casting is too long. In Comparative Examples 19, 21 and 23, the cooling/solidification rate during casting is too slow. In Comparative Examples 20, 22 and 23, the required time from the ejection of the ingot from the heating furnace to the initiation of hot rolling is too long.

Accordingly, in the copper alloys of these comparative examples, the ratio of the amount of Mg in the extracted residue extracted and separated by the abovementioned extracted residue method to the Mg content of the alloy exceeds 60%. As a result, the strength and bending workability are both low.

The significance of the composition and structure of the copper alloy plates of the present invention for obtaining a superior bending workability in addition to a high strength and high conductivity, and of the desirable manufacturing conditions for obtaining this structure, is supported by the abovementioned results.

TABLE 1

| Category | No. | Chemical Composition of Copper Alloy Plate (remainder Cu and impurities) Mg | P | Fe | Ni | Co | Zn | Sn | Time to Initiation of Casting Sec | Cooling Solidification Rate of Casting ° C./sec | Heating Furnace Extraction Temperature ° C. | Temperature at Completion of Hot Rolling ° C. | Time to Initiation of Hot Rolling sec. |
|---|---|---|---|---|---|---|---|---|---|---|---|---|---|
| Present Invetion | 1 | 0.23 | 0.11 | 0.17 | — | — | — | — | 900 | 2 | 960 | 800 | 500 |
| | 2 | 0.12 | 0.11 | 0.17 | — | — | — | — | 600 | 1 | 950 | 730 | 900 |
| | 3 | 0.85 | 0.11 | 0.17 | — | — | — | — | 1000 | 2 | 920 | 700 | 800 |
| | 4 | 0.23 | 0.03 | 0.17 | — | — | — | — | 600 | 0.5 | 970 | 810 | 500 |
| | 5 | 0.23 | 0.35 | 0.17 | — | — | — | — | 700 | 1 | 900 | 650 | 1000 |
| | 6 | 0.23 | 0.11 | 0.03 | — | — | — | — | 600 | 1 | 970 | 720 | 1050 |
| | 7 | 0.23 | 0.11 | 0.88 | — | — | — | — | 800 | 1.5 | 960 | 760 | 800 |
| | 8 | 0.23 | 0.11 | 0.17 | — | — | 0.5 | — | 600 | 1 | 960 | 810 | 600 |
| | 9 | 0.23 | 0.11 | 0.17 | — | — | — | 0.5 | 900 | 1.5 | 930 | 700 | 900 |
| | 10 | 0.23 | 0.11 | 0.17 | — | — | 0.1 | 0.1 | 900 | 2 | 950 | 750 | 700 |
| | 11 | 0.23 | 0.11 | 0.17 | 0.17 | — | — | — | 600 | 1.5 | 920 | 700 | 900 |
| | 12 | 0.23 | 0.11 | 0.17 | — | 0.17 | — | — | 600 | 1 | 950 | 800 | 550 |
| | 13 | 0.23 | 0.11 | 0.17 | 0.17 | 0.17 | 0.1 | 0.1 | 600 | 1 | 950 | 820 | 500 |
| Comparative Examples | 14 | 0.02 | 0.11 | 0.17 | — | — | 0.1 | 0.1 | 600 | 1.5 | 950 | 770 | 600 |
| | 15 | 1.2 | 0.11 | 0.17 | — | — | 0.1 | 0.1 | 600 | 1.5 | 970 | 800 | 500 |
| | 16 | 0.23 | 0.006 | 0.17 | — | — | 0.1 | 0.1 | 600 | 1.5 | 930 | 720 | 750 |
| | 17 | 0.23 | 0.45 | 0.17 | — | — | 0.1 | 0.1 | 600 | 1.5 | 960 | 750 | 700 |
| | 18 | 0.23 | 0.11 | 0.17 | — | — | 0.1 | 0.1 | 2400 | 1 | 960 | 760 | 750 |
| | 19 | 0.23 | 0.11 | 0.17 | — | — | 0.1 | 0.1 | 600 | 0.05 | 920 | 740 | 600 |
| | 20 | 0.23 | 0.11 | 0.17 | — | — | 0.1 | 0.1 | 600 | 1 | 980 | 660 | 1400 |
| | 21 | 0.23 | 0.11 | 0.17 | — | — | 0.1 | 0.1 | 1800 | 0.07 | 950 | 720 | 800 |
| | 22 | 0.23 | 0.11 | 0.17 | — | — | 0.1 | 0.1 | 1500 | 1 | 970 | 680 | 1300 |
| | 23 | 0.23 | 0.11 | 0.17 | — | — | 0.1 | 0.1 | 600 | 0.07 | 950 | 650 | 1350 |

TABLE 2

| Category | No. | Alloy Plate Composition: Amount of Extracted Residue Mg (%) | Ratio of Amount of Extracted Residue Mg to Alloy (%) | Alloy Plate Characteristics: Tensile Strength (MPa) | 0.2% Yield Stress (MPa) | Conductivity (% IACS) | Bending |
|---|---|---|---|---|---|---|---|
| Present Invention | 1 | 0.066 | 29 | 443 | 424 | 69 | ○ |
| | 2 | 0.054 | 45 | 435 | 416 | 69 | ○ |
| | 3 | 0.19 | 22 | 471 | 450 | 60 | ○ |
| | 4 | 0.090 | 39 | 436 | 418 | 69 | ○ |
| | 5 | 0.075 | 33 | 445 | 425 | 65 | ○ |
| | 6 | 0.12 | 52 | 434 | 415 | 69 | ○ |
| | 7 | 0.070 | 30 | 443 | 426 | 65 | ○ |
| | 8 | 0.060 | 26 | 461 | 440 | 61 | ○ |
| | 9 | 0.056 | 24 | 465 | 442 | 60 | ○ |
| | 10 | 0.054 | 23 | 460 | 438 | 64 | ○ |
| | 11 | 0.065 | 28 | 453 | 431 | 67 | ○ |
| | 12 | 0.062 | 27 | 455 | 434 | 66 | ○ |

TABLE 2-continued

| Category | No. | Alloy Plate Composition: Amount of Extracted Residue Mg (%) | Ratio of Amount of Extracted Residue Mg to Alloy (%) | Alloy Plate Characteristics: Tensile Strength (MPa) | 0.2% Yield Stress (MPa) | Conductivity (% IACS) | Bending |
|---|---|---|---|---|---|---|---|
| | 13 | 0.060 | 26 | 467 | 444 | 62 | ○ |
| Comparative Examples | 14 | 0.002 | 10 | 391 | 370 | 65 | ○ |
| | 15 | 0.80 | 67 | 430 | 408 | 50 | X |
| | 16 | 0.018 | 8 | 400 | 377 | 63 | ○ |
| | 17 | 0.17 | 74 | 420 | 400 | 52 | X |

TABLE 2-continued

| Category | No. | Alloy Plate Composition: Amount of Extracted Residue Mg (%) | Ratio of Amount of Extracted Residue Mg to Alloy (%) | Alloy Plate Characteristics: Tensile Strength (MPa) | 0.2% Yield Stress (MPa) | Conductivity (% IACS) | Bending |
|---|---|---|---|---|---|---|---|
| | 18 | 0.15 | 65 | 429 | 407 | 65 | X |
| | 19 | 0.17 | 74 | 420 | 402 | 66 | X |
| | 20 | 0.16 | 70 | 424 | 405 | 65 | X |
| | 21 | 0.18 | 78 | 417 | 398 | 66 | X |
| | 22 | 0.18 | 78 | 416 | 396 | 66 | X |
| | 23 | 0.19 | 83 | 410 | 392 | 67 | X |

Next, Table 3 shows examples in which the amounts of the abovementioned selectively added elements and other elements (impurities) in the copper alloy exceed the abovementioned desirable stipulated upper limits. These examples were all manufactured as copper alloy thin plates with a thickness of 0.2 mm under the same conditions as in the abovementioned Example 1 of the present invention (required time to initiation of casting 900 seconds, cooling/solidification rate during casting 2° C./sec, heating furnace extraction temperature 960° C., heating upon completion of hot rolling 800° C., required time to initiation of hot rolling 500 seconds). These copper alloy thin plates were evaluated for characteristics such as strength, conductivity, bendability and the like in the same manner as in the examples described above. The results obtained are shown in Table 4.

Example 24 of the present invention in Table 3 corresponds to example 1 of the present invention in the abovementioned example Tables 1 and 2. The amounts of other elements (impurities) of group A and group B shown in Table 3 are indicated more concretely.

In Example 25 of the present invention, the contents of Mn, Ca, Zr, Ag, Cr, Cd, Be, Ti, Co, Ni, Au and Pt as elements of group A in Table 3 are large.

In Example 26 of the present invention, the contents of Hf, Th, Li, Na, K, Sr, Pd, W, S, Si, C, Nb, Al, V, Y, Mo, Pb, In, Ga, Ge, As, Sb, Bi, Te, B and mischmetal as elements of group B in Table 3 are such that the total amount of these elements exceeds 0.1 mass %.

Examples 27 and 28 of the present invention have a large Zn content. Examples 29 and 30 of the present invention have a large Sn content.

In these Examples 25 through 30 of the present invention, the contents of the main elements Fe, P and Mg are within the composition ranges of the present invention, and these alloys were manufactured under desirable conditions. Accordingly, in these Examples 25 through 30 of the present invention, the composition was controlled so that the ratio of the amount of Mg in the extracted residue extracted and separated by the abovementioned extracted residue method to the Mg content of the alloy was 60% or less, thus reducing the size of the oxides and precipitates of Mg in the copper alloy.

As a result, in Examples 25 through 30 of the present invention, a high strength is balanced with a high conductivity, i.e., a yield stress of 400 MPa or greater, and a conductivity of 60% IACS or greater, or a yield stress of 450 MPa or greater, and a conductivity of 55% IACS or greater; furthermore, the bending workability is superior. However, since the contents of the other elements of group A and group B are high, the conductivity is low compared to that of Example 24 of the present invention (corresponding to Example 1 of the present invention in Tables 1 and 2).

Comparative Examples 31 and 32 contain Zn and Sn in excess of the respective stipulated upper limits. In these Comparative Examples 31 and 32 as well, the contents of the main elements Fe, P and Mg are within the composition ranges of the present invention, and these alloys were manufactured under desirable conditions. Accordingly, in Comparative Examples 31 and 32, the composition was controlled so that the ratio of the amount of Mg in the extracted residue extracted and separated by the abovementioned extracted residue method stipulated in the present invention to the Mg content of the alloy was 60% or less, thus reducing the size of the oxides and precipitates of Mg in the copper alloy. As a result, Comparative Examples 31 and 32 also have a high strength and a superior bending workability. However, since the contents of Zn and Sn are excessively high, i.e., in excess of the upper limit, the conductivity is conspicuously low even when compared to the conductivity of Examples 25 through 30 of the present invention.

TABLE 3

| | | Chemical Composition of Copper Alloy Plate (remainder Cu) | | | | | | | | |
|---|---|---|---|---|---|---|---|---|---|---|
| Category | No. | Mg | P | Fe | Ni | Co | Zn | Sn | A group total | B group total |
| Present Invention | 24 | 0.23 | 0.11 | 0.17 | — | — | — | — | 0.05 | 0.02 |
| | 25 | 0.25 | 0.10 | 0.15 | — | — | — | — | 0.55 | 0.02 |
| | 26 | 0.25 | 0.10 | 0.15 | — | — | — | — | 0.12 | 0.12 |
| | 27 | 0.25 | 0.10 | 0.15 | — | — | 1.6 | — | 0.12 | 0.02 |
| | 28 | 0.25 | 0.10 | 0.15 | — | — | 2.5 | — | 0.12 | 0.02 |
| | 29 | 0.25 | 0.10 | 0.15 | — | — | | 1.5 | 0.12 | 0.02 |
| | 30 | 0. 25 | 0.10 | 0.15 | — | — | — | 4.0 | 0.12 | 0.02 |
| Comparative Examples | 31 | 0.25 | 0.10 | 0.15 | — | — | 3.5 | — | 0.12 | 0.02 |
| | 32 | 0.25 | 0.10 | 0.15 | — | — | — | 5.5 | 0.12 | 0.02 |

*A group indicates the respective elements of Mn, Ca, Zr, Ag, Cr, Cd, Be, Ti, Co, Ni, Au and Pt.
*B group indicates the respective elements of Hf, Th, Li, Na, K, Sr, Pd, W, S, Si, C, Nb, Al, V, Y, Mo, Pb, In, Ga, Ge, As, Sb, Bi, Te, B and mischmetal.

TABLE 4

| | | Alloy Plate Composition | | Alloy Plate Characteristics | | | |
|---|---|---|---|---|---|---|---|
| Category | No. | Amount of Extracted Residue Mg (%) | Ratio of Amount of Extracted Residue Mg to Alloy (%) | Tensile Strength (MPa) | 0.2% Yield Stress (MPa) | Conductivity (% IACS) | Bending |
| Present Invention | 24 | 0.066 | 29 | 443 | 424 | 69 | ○ |
| | 25 | 0.074 | 30 | 452 | 431 | 63 | ○ |
| | 26 | 0.073 | 29 | 450 | 429 | 65 | ○ |
| | 27 | 0.072 | 29 | 447 | 427 | 61 | ○ |
| | 28 | 0.072 | 29 | 455 | 433 | 60 | ○ |
| | 29 | 0.073 | 29 | 477 | 455 | 59 | ○ |
| | 30 | 0.072 | 29 | 500 | 476 | 56 | ○ |
| Comparative Examples | 31 | 0.072 | 29 | 458 | 435 | 57 | ○ |
| | 32 | 0.073 | 29 | 502 | 479 | 52 | ○ |

Second Embodiment

In the present invention, in order to achieve a high strength, high conductivity and high bending workability, a basic composition is used which comprises a copper alloy respectively containing 0.01 to 3.0% Fe, 0.01 to 0.4% P, and 0.1 to 1.0% Mg (in mass %), with the remainder comprising copper and unavoidable impurities. This composition is also an important prerequisite condition from the standpoint of the composition that is necessary for reducing the grain size of the copper alloy structure, and suppressing the variation of the individual grain size values, and for depositing fine precipitated particles (without coarsening these particles). Furthermore, the percentages indicated in the following description of the respective elements are all mass %.

The following elements may be added to this basic composition in order to improve the bending workability.

Ni or Co, or both, at a total rate of 0.01 to 1.0 mass %.

Zn: 0.005 to 3.0%

Sn: 0.01 to 5.0%

Mn or Ca, or both, at a total rate of 0.0001 to 1.0%.

One or more elements selected from a set comprising Zr, Ag, Cr, Cd, Be, Ti, Co, Ni, Au and Pt, at a total rate of 0.001 to 1.0%.

Hf, Th, Li, Na, K, Sr, Pd, W, S, Si, C, Nb, Al, V, Y, Mo, Pb, In, Ga, Ge, As, Sb, Bi, Te, B and mischmetal at a total content of 0.1 mass % or less.

(Fe)

Fe is an element that is necessary in order to improve the strength and conductivity by forming fine deposits of Fe—P and the like. At a content of less than 0.01%, the fine precipitated particles are insufficient. As a result, the effect of the precipitated particles in suppressing the growth of the crystal grains is diminished. Consequently, the mean grain size and the standard deviation of the mean grain size becomes excessively large, so that the strength drops. Accordingly, a content of 0.01% or greater is required in order to effectively manifest these effects. However, if this content exceeds 3.0%, this leads to a coarsening of the precipitated particles, so that the standard deviation of the mean grain size becomes excessively large, and the bending workability drops. Furthermore, the conductivity also drops. Accordingly, the Fe content is set in the range of 0.01 to 3.0%.

(P)

In addition to having a deoxidizing effect, P bonds with Fe to form deposits such as Fe—P and the like, and is an element that is necessary in order to improve the strength and conductivity of the copper alloy. Furthermore, P also improves the strength and conductivity of the copper alloy by bonding with Mg to form deposits such as Mg—P and the like. If the P content is too small, these effects and the fine precipitated particles are insufficient. Accordingly, the effect of the precipitated particles in suppressing crystal grain growth is diminished. As a result, the mean grain size and the standard deviation of the mean grain size become excessively large, so that the strength drops. Accordingly, a content of 0.01% or greater is necessary. However, if this content exceeds 0.4%, the standard deviation of the mean grain size becomes excessively large along with an increase in the coarse precipitated particles, so that the bending workability drops. Furthermore, the conductivity also drops. Accordingly, the P content is set in the range of 0.01 to 0.4%.

(Mg)

Mg forms fine deposits with P, and is an element that is required in order to improve the strength and conductivity. If the Mg content is too small, these effects and the fine precipitated particles will be insufficient. Accordingly, the effect of the precipitated particle in suppressing crystal grain growth is diminished. As a result, the mean grain size and standard deviation of the mean grain size become excessively large, so that the strength drops. Accordingly, a content of 0.1% or greater is required. However, if this content exceeds 1.0%, the precipitated particles are coarsened, and the standard deviation of the mean grain size becomes excessively large, so that the bending workability also drops. Furthermore, the conductivity also drops. Accordingly, the Mg content is set in the range of 0.1 to 1.0%.

(Ni, Co)

The copper alloy may further contain Ni or Co, or both, at a total content of 0.01 to 1.0%. Like Mg, Ni and Co are dispersed in the copper alloy as fine precipitated particles of (Ni,Co)—P, (Ni.Co)—Fe—P and the like, and improve the strength and conductivity. A content of 0.01% or greater is required in order to manifest these effects in an effective manner. However, if this content exceeds 1.0%, this leads to a coarsening of the precipitated particles, and the standard deviation of the mean grain size becomes excessively large, so that the bending workability drops. Furthermore, the conductivity also drops. Accordingly, the total content of Ni or Co, or both, in the case of selective inclusion is set in the range of 0.01 to 1.0%.

(Zn)

The copper alloy may also contain Zn or Sn, or both. Zn is an element that is effective in improving the thermal peeling resistance of Sn plating or solder used in the joining of electronic parts, and thus suppressing thermal peeling. It is desirable that the content be 0.005% or greater in order to manifest such an effect in an effective manner. However, if this content exceeds 3.0%, this not only causes a deterioration in the flow spreading characteristics of molten Sn and solder, but also causes a great drop in conductivity. Accordingly, in order to balance the thermal peeling resistance improving effect and conductivity lowering effect, Zn is selectively included in the range of 0.005 to 3.0 mass %.

(Sn)

Sn goes into solid solution in the copper alloy, and contributes to an improvement of the strength. In order to manifest such an effect in an effective manner, it is desirable to include this element at a content of 0.01% or greater. However, if this content exceeds 5.0%, the effect becomes saturated, and this causes a great drop in the conductivity. Accordingly, in order to balance the effect that improves the strength and the effect that lowers the conductivity, this element Sn is selectively included in the range of 0.01 to 5.0 mass %.

(Mn, Ca)

Mn and Ca contribute to an improvement in the hot workability of the copper alloy, and are selectively included in cases where such an effect is required. In cases where the total content of Mn or Ca, or both, is less than 0.0001%, the desired effect cannot be obtained. On the other hand, if this total content exceeds 1.0%, coarse crystal deposits and oxides are generated, so that not only is the bending workability reduced, but the drop in conductivity also becomes severe. Accordingly, the total content of these elements is selectively set in the range of 0.0001 to 1.0%.

(Amounts of Zr, Ag, Cr, Cd, Be, Ti, Au and Pt)

These components have an effect in improving the strength of the copper alloy, and are therefore selectively included in cases where such an effect is required. In cases where the total content of one or more of these components is less than 0.001%, the desired effect cannot be obtained. On the other hand, in cases where the total content of these components exceeds 1.0%, coarse crystal deposits and oxides are generated, so that not only is the bending workability reduced, but the drop in conductivity also becomes severe, which is undesirable. Accordingly, the total content of these elements is selectively set in the range of 0.001 to 1.0%.

(Amounts of Hf, Th, Li, Na, K, Sr, Pd, W, S, Si, C, Nb, Al, V, Y, Mo, Pb, In, Ga, Ge, As, Sb, Bi, Te, B and Mischmetal)

These components are impurity elements; if the total content of these elements exceeds 0.1%, coarse crystal deposits and oxides are generated so that the bending workability drops. Accordingly, it is desirable that the total content of these elements be set at 0.1% or less.

(Copper Alloy Structure)

In the present invention, as was described above, the grain size of the copper alloy structure is made finer, and the variation in the individual grain size values is suppressed, in order to prevent a deterioration in the bending workability of the abovementioned Cu—Mg—P—Fe alloy having a composition with improved strength. In particular, in a Cu—Mg—P—Fe alloy, not only the mean grain size, but also the variation in the grain size, has a great effect on the bending workability. Accordingly, in the present invention, in order to obtain a copper alloy which has a high strength and a superior bending workability in a good balance, coarse crystal grains in the copper alloy structure are reduced, and the individual grain size values are made as fine as possible.

As a measure of this, the mean grain size (described below) is set at 6.5 μm or less, preferably 4 μm or less, and the standard deviation of the mean grain size (described below) is set at 1.5 μm or less, preferably 0.9 μm or less, in the grain size measured by a crystal orientation analysis method in which an electron back scattering pattern system is mounted on a field emission scanning electron microscope.

Here, where n indicates the number of crystal grains measured, and x indicates the grain size values measured, the abovementioned mean grain size is expressed as $(\Sigma x)/n$, and the standard deviation of the abovementioned mean grain size is expressed as $[n\Sigma x^2-(\Sigma x)^2]/[n/(n-1)^{1/2}]$.

In cases where the abovementioned mean grain size exceeds 6.5 μm, or the abovementioned standard deviation of the mean grain size exceeds 1.5 μm, the coarse crystal grains in the copper alloy structure increase, and the variation in the individual grain size values also increases, so that the bending workability deteriorates.

(Method Used to Measure Mean Grain size and Standard Deviation of Mean Grain Size)

In the present invention, the reason that the measurement method used to measure the mean grain size and the standard deviation of the mean grain size is stipulated as the abovementioned crystal orientation analysis method in which an electron back scattering (scattered) pattern (EBSP) system is mounted on a field emission scanning electron microscope (FESEM) is that this measurement method has a high resolution and high precision.

In the EBSP method, a sample set in the lens barrel of the FESEM is irradiated with an electron beam, and an EBSP is projected onto a screen. An image of this is picked up by a high-speed camera, and is taken into a computer as an image. In the computer, this image is analyzed, and is compared with a pattern produced by a simulation using a known crystal system, so that the orientation of the crystal is determined. The calculated crystal orientation is recorded as the three-dimensional Euler angle along with the position coordinates (x, y) and the like. Since this process is performed automatically for all of the measurement points, crystal orientation data for several tens of thousands to several hundred thousand points is obtained upon the completion of measurement.

Thus, the EBSP method offers the following advantage: namely, the visual field of observation is broader than in the X-ray diffraction method or electron diffraction method using a transmission electron microscope, and mean grain size values, mean grain size standard deviations or orientation analysis information for several hundred or more crystal grains can be obtained within a few hours. Furthermore, the following advantage is also obtained: namely, since measurement is performed by scanning a designated region in an arbitrary fixed interval rather than performing measurements for each crystal grain, the abovementioned respective items of information can be obtained for the abovementioned numerous measurement points that encompass the measurement region as a whole. Furthermore, details concerning this crystal orientation analysis method in which an EBSP system is mounted on an FESEM are described in Kobe Seiko Giho [Kobe Steelmaking Technical Report]/Vol. 52, No. 2 (September 2002), pp. 66 to 70 and the like.

In the present invention, the aggregate structure of the surface parts of the product copper alloy in the direction of plate thickness are measured using this crystal orientation analysis method in which an EBSP system is mounted on an FESEM, and the mean grain size, standard deviation of the mean grain size and small-angle grain boundaries are measured.

Here, in the case of an ordinary copper alloy plate, mainly an aggregate structure formed from numerous orientation factors called the cube orientation, goss orientation, brass orientation (hereafter also referred to as the B orientation), copper orientation (hereafter also referred to as the Cu orientation), S orientation and the like as shown below is formed, and crystal planes corresponding to these orientation factors are present. For example, these facts are described in Shin'ichi Nagashima (ed.), "Shugo Soshiki" ["Aggregate Structure"] (published by Maruzen K. K.) and Keikinzoku Gakkai [Light Metal Society] "Keikinzoku" ["Light Metals"] Treatise, Vol. 43, 1993, pp. 285 to 293 and the like.

Even in the case of the same crystal system, the formation of such aggregate structures differs according to the working and heat treatment method. In the case of the aggregate structure of a plate material obtained by rolling, this is expressed by the rolling plane and rolling direction, the rolling plane is expressed by (ABC), and the rolling direction is expressed by <DEF> (A, B, C, D, E and F indicate integers). On the basis of such an expression, the respective orientations are expressed as follows:

| | |
|---|---|
| Cube orientation | {001} <100> |
| Goss orientation | {011} <100> |
| Rotated goss orientation | {011} <011> |
| Brass orientation (B orientation) | {011} <211> |
| Copper orientation (Cu orientation) | {112} <111> |
| (or D orientation | {4 4 11} <11 11 8>) |
| S orientation | {123} <634> |
| B/G orientation | {011} <511> |
| B/S orientation | {168} <211> |
| P orientation | {011} <111> |

In the present invention, basically, planes with a shift in orientation that is within ±15° from these crystal planes are considered to belong to the same crystal plane (orientation factor). Furthermore, boundaries of crystal grains in which the difference in orientation between adjacent crystal grains is 5° or greater are defined as crystal grain boundaries.

Furthermore, in the present invention, where n indicates the number of crystal grains measured by the abovementioned crystal orientation analysis method, and x indicates the respective measured grain size values, the abovementioned mean grain size is expressed as $(\Sigma x)/n$, and the standard deviation of the abovementioned mean grain size is expressed as $[n\Sigma x^2-(Ex)^2]/[n/(n-1)^{1/2}]$.

(Small-Angle Grain Boundaries)

In the present invention, in addition to the abovementioned control of the grain size, the ratio of small-angle grain boundaries is preferably further stipulated in order to further improve the bending workability. These small-angle grain boundaries are grain boundaries between crystal grains in which the difference in crystal orientation is small, i.e., to 15°, among the crystal orientations measured by the abovementioned crystal orientation analysis method in which an EBSP system is mounted on an FESEM. In the present invention, it is desirable that the ratio of these small-angle grain boundaries be 4% to 30%, as the ratio of the total length of these small-angle crystal grain boundaries measured by the abovementioned crystal orientation analysis method mounting an EBSP system (total length of all of the measured crystal grain boundaries of small-angle grains) to the total length of the similarly measured crystal grain boundaries with a difference in crystal orientation of 5 to 180° (total length of the crystal grain boundaries of all of the measured crystal grains).

Specifically, the ratio (%) of small-angle grain boundaries, expressed as [(total length of 5 to 15° crystal grain boundaries)/(total length of 5 to 180° crystal grain boundaries)]×100, is 4% to 30%, preferably 5% to 25%.

In the Cu—Mg—P—Fe alloy of the present invention, not only the abovementioned mean grain size and standard deviation of the mean grain size, but also the ratio of small-angle grain boundaries, has a great effect on the bending workability. Accordingly, in order to achieve a reliable improvement in the bending workability of the Cu—Mg—P—Fe alloy, it is desirable that the ratio of small-angle grain boundaries to total crystal grain boundaries in terms of the length of the crystal grain boundaries be 4% to 30%. In cases where this ratio of small-angle grain boundaries is less than 4%, there is a possibility that instances may occur in which the bending workability cannot be improved. In cases where this ratio of small-angle grain boundaries exceeds 30%, the strength becomes excessively large, and the bending workability cannot be improved.

(Manufacturing Conditions)

Next, desirable manufacturing conditions for forming the structure of the copper alloy as the abovementioned structure stipulated by the present invention will be described. The copper alloy of the present invention is basically a copper alloy plate; strips that are formed by slitting this plate in the lateral direction, and configurations formed by coiling these strips, are also included in the scope of the copper alloy of the present invention.

In the present invention, as in a general manufacturing process, the final (product) plate is obtained by repeating the casting of a copper alloy melt adjusted to a specified composition, planing of the ingot, soaking, hot rolling, cold rolling, and annealing including recrystallization annealing, deposition annealing and the like. However, by combining the respective manufacturing conditions described below within the abovementioned manufacturing process, it is possible to obtain the structure specified by the present invention, and to obtain a high strength, high conductivity and superior bending workability.

First, the temperature upon completion of hot rolling is set at 550 to 850° C. If hot rolling is performed in a temperature region that is lower than 550° C., recrystallization is incomplete, so that a nonuniform structure is obtained; furthermore, the standard deviation becomes excessively large, and the bending workability deteriorates. If the temperature upon completion of hot rolling exceeds 850° C., the crystal grains are coarsened, and the bending workability deteriorates. Following this hot rolling, water cooling is performed.

Next, following this water cooling, the cold rolling rate in cold rolling (prior to annealing for the purpose of recrystallization) is set at 70 to 98%. If the cold rolling rate is lower than 70%, the sites that constitute recrystallization nuclei become too few, so that the grain size is inevitably increased to a value exceeding the mean grain size that is to be obtained in the present invention, thus causing a deterioration in the bending workability. On the other hand, if the cold rolling rate exceeds 98%, the variation in the grain size is increased; consequently, the crystal grains become nonuniform, and the standard deviation of the mean grain size is inevitable increased to a value exceeding the standard deviation of the mean grain size that is to be obtained in the present invention, thus likewise causing a deterioration in the bending workability.

Next, annealing (formation of solid solution) for the purpose of recrystallization is performed. In this case, in order to suppress the growth of crystal grains, it is desirable to select a temperature of 550 to 700° C. on the low-temperature side within the range of 550 to 850° C. as the recrystallization annealing temperature. In this recrystallization annealing, in order to suppress the growth of crystal grains, it is necessary to further control both the heating rate and cooling rate. Specifically, the heating rate in this annealing is set at 50° C./s or greater. If the heating rate is less than 50° C./s, the formation of nuclei for the recrystallized particles becomes nonuniform, so that the standard deviation of the mean grain size is inevitably increased. Furthermore, the cooling rate following this annealing is set at 100° C./s or greater. If this cooling rate is less than 100° C./s, the growth of crystal grains during annealing is promoted, so that the mean grain size is inevitably increased to a value exceeding the mean grain size that is to be obtained in the present patent.

Following this recrystallization annealing, deposition annealing (intermediate annealing or secondary annealing) is performed at a temperature in the range of approximately 300 to 450° C., thus forming fine deposits so that the strength and conductivity of the copper alloy plate are improved (recovered).

The cold rolling rate in the final cold rolling that is performed after these annealing processes is set in the range of 10 to 30%. The ratio of small-angle grain boundaries can be increased by introducing strain by means of this final cold rolling. If the final cold rolling rate is less than 10%, sufficient strain cannot be introduced, so that the ratio of small-angle grain boundaries does not increase to a value exceeding the abovementioned 4%. On the other hand, if the final cold rolling rate exceeds 30%, the strength becomes excessively large, and the mean grain size also becomes excessively large, so that the bendability deteriorates. Furthermore, intermediate annealing for the purpose of recovering the conductivity may be performed following the abovementioned recrystallization annealing and prior to this final cold rolling.

The copper alloy of the present invention thus obtained has a high strength and high conductivity, and can be widely and effectively utilized in household electrical appliances, semiconductor parts, industrial devices, and electrical and electronic parts used in automobiles.

Below, the present invention will be described more concretely in terms of examples. However, the present invention is not restricted by any of the examples described below; this invention can of course be worked by adding appropriate alterations within limits conforming to the gist of the invention described above and below, and all of these configurations are included in the technical scope of the present invention.

Second Examples

Examples of the present invention will be described below. Various types of copper alloy thin plates comprising Cu—Mg—P—Fe alloys in which the mean grain size in the structure, the standard deviation of the mean grain size and the like were different, were manufactured, and characteristics such as the strength, conductivity, bendability and the like were evaluated.

Specifically, copper alloys having the chemical compositions shown in Table 5 were respectively prepared in a coreless furnace, and were formed into ingots in a semi-continuous casting process, thus producing ingots with a thickness of 70 mm, a width of 200 mm and a length of 500 mm. The surfaces of these respective ingots were planed, and the ingots were then heated for 2 hours at 950° C., after which hot rolling was performed to form plates with a thickness of 20 mm; these plates were then rapidly cooled in water from the various temperatures shown in Table 6 below.

Next, following the removal of oxidation scale, primary cold rolling (intermediate rolling) was performed at the various cold rolling rates shown in Table 6 below. Following the planing of these plates, recrystallization annealing was performed as primary annealing at a temperature of 600° C. and at the various heating rates and cooling rates shown in Table 6 below. Subsequently, deposition annealing (secondary annealing) for the purpose of recovering the conductivity was performed for 10 hours at 400° C.; then, final cold rolling was performed at the various cold rolling rates shown in Table 6 below. Then, strain-removal annealing at an extremely low temperature was performed, thus producing product copper alloy plates having a thickness of 0.2 mm.

Furthermore, in all of the respective copper alloys shown in Table 5, the remainder of the alloy consisted of Cu except for unavoidable impurities. Furthermore, the total content of Zr, Ag, Cr, Cd, Be, Ti, Au and Pt as elements other than those described in Table 5 was 0.05 mass %. Furthermore, the total content of the elements Hf, Th, Li, Na, K, Sr, Pd, W, S, Si, C, Nb, Al, V, Y, Mo, Pb, In, Ga, Ge, As, Sb, Bi, Te, B and mischmetal (MM) was also 0.1 mass % or less. "–" shown in the respective element contents shown in Table 5 indicates that the element was below the detection limit.

(Mean Grain Size, Standard Deviation of Mean Grain Size and Ratio of Small-Angle Grain Boundaries)

The mean grain size, standard deviation of the mean grain size and small-angle grain boundaries of these product copper alloy plates were measured. In regard to these measurements, as was described above, a crystal orientation analysis method in which an EBSP system was mounted on an FESEM was used, and the aggregate structure of the surface parts of the product copper alloy plates in the direction of plate thickness was measured. The results obtained are shown in Table 6.

In concrete terms, the rolled surface of the product copper alloy was mechanically polished, and samples were prepared in which the surface was further adjusted by buffing and electrolytic polishing. Next, crystal orientation measurement and grain size measurement by EBSP were performed using an FESEM (JEOL JSM 5410) manufactured by NEC. The measurement region was a region having a size of 300 μm×300 μm, and the measurement step interval was set at 0.5 μm. The EBSP measurement and analysis system used was a (OIM) manufactured by EBSP:TLS Co.

Furthermore, in all of the examples, a sample was cut from the copper alloy plate obtained, and was subjected to a tension test, conductivity measurement and a bending test. These results are also shown in Table 6.

(Tension Test)

The tension test was performed by means of a universal tester (Model 5882) manufactured by Instron Co. using a test sample according to JIS 13B, with the longitudinal direction taken as the rolling direction, and the tensile strength and 0.2% yield stress (MPa) were measured at room temperature and at a test speed of 10.0 mm/min, with GL set at 50 mm.

(Conductivity Measurement)

The conductivity was measured as follows: namely, rectangular samples with a width of 10 mm and a length of 300 mm were worked by milling with the longitudinal direction of the sample taken as the rolling direction, and the electrical resistance was measured by means of a double bridge type resistance measuring device. The conductivity was then calculated by the mean cross-sectional area method.

(Test Evaluating Bending Workability)

A bending test of the copper alloy plate samples was performed according to the Nippon Shindo Kyokai Technical Standard. The plate material was cut to a width of 10 mm and a length of 30 mm, and bending was performed the "good way" (with the bending axis perpendicular to the rolling direction) at a bending radius of 0.05 mm. The presence or absence of cracks in the bent parts was visually observed using a 50× optical microscope. In this case, samples that had no cracks were evaluated as o, samples showing surface roughness were evaluated as Δ, and samples in which cracking occurred were evaluated as ×. A sample showing superior results in this bending test may also be said to be superior in terms of severe bending workability such as the abovementioned U-bending, 90° bending after notching or the like.

As is clear from Table 5, in examples 1 through 14 of the invention, which are copper alloys within the composition of the present invention, product copper alloy plates are obtained with the primary cold rolling (cold rolling rate), recrystallization annealing (heating rate, cooling rate) and final cold rolling (cold rolling rate) with desirable condition ranges.

Accordingly, the structures of examples 1 through 14 of the invention were controlled so that the mean grain size was 6.5 μm or less, the standard deviation of the mean grain size was 1.5 μm or less, and the ratio of small-angle grain boundaries in which the difference in crystal orientation was 5 through 15° was 4% or greater (as measured by the abovementioned crystal orientation analysis method in which an electron back scattering pattern system was mounted on a field emission scanning electron microscope).

As a result, examples 1 through 14 of the present invention showed a high strength and high conductivity, i.e., a yield stress of 400 MPa or greater and a conductivity of 60% IACS or greater, and were also superior in terms of bending workability.

On the other hand, in the case of the copper alloy of Comparative Example 15, the Fe content was below the lower limit of 0.01%. Accordingly, in spite of the fact that this alloy was manufactured under the same desirable conditions as the abovementioned examples of the invention, the fine precipitated particles were insufficient, and the mean grain size and standard deviation of the mean grain size exceeded the upper limits of the specified ranges. As a result, although the bending workability was superior, the strength was especially low.

In the case of the copper alloy of Comparative Example 16, the Fe content exceeded the upper limit of 3.0%. Accordingly, in spite of the fact that this alloy was manufactured under the same desirable conditions as the abovementioned examples of the invention, the coarse precipitated particles were numerous, the mean grain size approached the upper limit, and the standard deviation of the mean grain size exceeded the upper limit. As a result, the bending workability was especially inferior.

In the case of the copper alloy of Comparative Example 17, the P content was less than the lower limit of 0.01%, so that the P content was too small. Accordingly, in spite of the fact that this alloy was manufactured under the same desirable conditions as the abovementioned examples of the invention, the fine precipitated particles were insufficient, and the mean grain size and standard deviation of the mean grain size exceeded the upper limit. As a result, although the bending workability was superior, the strength was especially low.

In the case of the copper alloy of Comparative Example 18, the P content exceeded the upper limit of 0.4%. Accordingly, in spite of the fact that this alloy was manufactured under the same desirable conditions as the abovementioned examples of the invention, there was an increase in coarse Mg—P precipitated particles; at the same time, the mean grain size approached the upper limit, and the standard deviation of the mean grain size exceeded the upper limit. As a result, the bending workability was especially inferior.

In the case of the copper alloy of Comparative Example 19, the Mg content was below the lower limit of 0.1%. Accordingly, in spite of the fact that this alloy was manufactured under the same desirable conditions as the abovementioned examples of the invention, the fine precipitated particles were insufficient, and the mean grain size and standard deviation of the mean grain size exceeded the upper limit. As a result, although the bending workability was superior, the strength was especially low.

In the case of the copper alloy of Comparative Example 20, the Mg content exceeded the upper limit of 1.0%. Accordingly, in spite of the fact that this alloy was manufactured under the same desirable conditions as the abovementioned examples of the invention, there was an increase in coarse Mg—P precipitated particles, the standard deviation of the mean grain size exceeded the upper limit. As a result, the bending workability was especially inferior.

In the copper alloys of Comparative Examples 21 through 28, in spite of the fact that the compositions were within the specified ranges, various manufacturing conditions departed from the desirable ranges. In Comparative Example 21, the temperature upon the completion of hot rolling was too low. In Comparative Example 22, the temperature upon the completion of hot rolling was too high. In Comparative Example 23, the cold rolling rate of primary cold rolling was too low. In Comparative Example 24, the cold rolling rate of primary cold rolling was too high. In Comparative Example 25, the heating rate of recrystallization annealing was too low. In Comparative Example 26, the cooling rate of recrystallization annealing was too low. In Comparative Example 27, the cold rolling rate of final cold rolling was too small. In Comparative Example 28, the cold rolling rate of final cold rolling was too high.

Accordingly, in the copper alloys of these Comparative Examples, all of the alloys showed the common feature of an inferior bending workability regardless of the strength level.

The significance of the composition and structure of the copper alloy plates of the present invention for obtaining superiority in terms of bending workability in addition to a high strength and high conductivity, and the significance of the desirable manufacturing conditions for obtaining this structure, are further supported by the above results.

TABLE 5

| | | Chemical Composition of Copper Alloy Plate (remainder Cu and impurities) | | | | | | | Temperature upon Completion of Hot Rolling | Cold Rolling Rate in Cold Rolling prior to Recrystallization Annealing | Heating Rate in Recrystallization Annealing | Cooling Rate in Recrystallization Annealing | Cold Rolling Rate in Final Cold Rolling |
|---|---|---|---|---|---|---|---|---|---|---|---|---|---|
| Category | No. | Mg | P | Fe | Ni | Co | Zn | Sn | ° C. | % | ° C./sec | ° C./sec | % |
| Present Invention | 1 | 0.23 | 0.10 | 0.15 | — | — | — | — | 690 | 90 | 100 | 200 | 25 |
| | 2 | 0.29 | 0.10 | 0.05 | — | — | — | — | 700 | 85 | 150 | 200 | 25 |
| | 3 | 0.24 | 0.10 | 2.60 | — | — | — | — | 700 | 98 | 80 | 150 | 20 |
| | 4 | 0.25 | 0.04 | 0.15 | — | — | — | — | 700 | 85 | 150 | 200 | 20 |
| | 5 | 0.25 | 0.35 | 0.15 | — | — | — | — | 760 | 98 | 80 | 150 | 20 |
| | 6 | 0.16 | 0.11 | 0.15 | — | — | — | — | 750 | 87 | 150 | 200 | 12 |
| | 7 | 0.93 | 0.10 | 0.15 | — | — | — | — | 560 | 98 | 80 | 150 | 12 |
| | 8 | 0.25 | 0.11 | 0.16 | 0.30 | — | — | — | 770 | 87 | 100 | 200 | 20 |
| | 9 | 0.24 | 0.12 | 0.15 | — | 0.30 | — | — | 770 | 87 | 100 | 200 | 20 |
| | 10 | 0.24 | 0.09 | 0.15 | 0.10 | 0.10 | — | — | 660 | 95 | 100 | 200 | 20 |
| | 11 | 0.25 | 0.09 | 0.14 | — | — | 0.30 | — | 790 | 85 | 100 | 200 | 17 |
| | 12 | 0.25 | 0.09 | 0.15 | — | — | — | 0.60 | 780 | 87 | 100 | 200 | 17 |
| | 13 | 0.25 | 0.10 | 0.15 | — | — | 0.20 | 0.30 | 750 | 87 | 100 | 200 | 17 |
| | 14 | 0.25 | 0.10 | 0.17 | 0. 10 | 0.10 | 0.10 | 0.10 | 740 | 68 | 100 | 200 | 17 |
| Comparative Examples | 15 | 0.25 | 0.10 | 0.005 | — | — | — | — | 750 | 95 | 100 | 200 | 20 |
| | 16 | 0.25 | 0.10 | 3.20 | — | — | — | — | 760 | 85 | 100 | 200 | 20 |
| | 17 | 0.23 | 0.001 | 0.15 | — | — | — | — | 750 | 95 | 100 | 200 | 25 |
| | 18 | 0.26 | 0.5 | 0.15 | — | — | — | — | 790 | 85 | 100 | 200 | 25 |
| | 19 | 0.001 | 0.10 | 0.15 | — | — | — | — | 720 | 95 | 100 | 200 | 17 |
| | 20 | 1.1 | 0.10 | 0.15 | — | — | — | — | 710 | 85 | 100 | 200 | 17 |
| | 21 | 0.24 | 0.10 | 0.15 | — | — | — | — | 530 | 93 | 80 | 200 | 15 |
| | 22 | 0.24 | 0.11 | 0.15 | — | — | — | — | 880 | 90 | 100 | 200 | 20 |
| | 23 | 0.25 | 0.10 | 0.15 | — | — | — | — | 800 | 65 | 100 | 200 | 20 |
| | 24 | 0.25 | 0.10 | 0.15 | — | — | — | — | 800 | 99 | 100 | 200 | 20 |
| | 25 | 0.25 | 0.10 | 0.15 | — | — | — | — | 800 | 90 | 45 | 200 | 20 |
| | 26 | 0.25 | 0.10 | 0.16 | — | — | — | — | 800 | 90 | 100 | 90 | 10 |
| | 27 | 0.25 | 0.10 | 0.16 | — | — | — | — | 800 | 90 | 100 | 200 | 5 |
| | 28 | 0.25 | 0.10 | 0.15 | — | — | — | — | 800 | 90 | 100 | 200 | 50 |

TABLE 6

| | | Alloy Plate Composition | | | Alloy Plate Characteristics | | |
|---|---|---|---|---|---|---|---|
| Category | No. | Mean Grain Size (μ m) | Standard Deviation of Grain Size (μ m) | Proportion of Small-angle Grain (%) | 0.2% Yield Stress (MPa) | Conductivity (% IACS) | Bending |
| Present Invention | 1 | 3.0 | 0.8 | 7.3 | 410 | 69.0 | ○ |
| | 2 | 2.1 | 0.6 | 5.3 | 401 | 71.0 | ○ |
| | 3 | 4.4 | 1.3 | 6.1 | 420 | 62.9 | Δ |
| | 4 | 2.9 | 0.8 | 6.8 | 403 | 72.1 | ○ |
| | 5 | 3.2 | 1.0 | 4.3 | 418 | 65.1 | Δ |
| | 6 | 1.5 | 0.4 | 10.7 | 403 | 72.0 | ○ |
| | 7 | 4.3 | 1.3 | 26.9 | 438 | 64.0 | Δ |
| | 8 | 2.5 | 0.7 | 9.3 | 425 | 66.3 | ○ |
| | 9 | 2.4 | 0.7 | 7.5 | 429 | 65.3 | ○ |
| | 10 | 2.2 | 0.6 | 6.2 | 431 | 66.1 | ○ |
| | 11 | 3.0 | 0.9 | 10.1 | 436 | 63.1 | ○ |
| | 12 | 3.2 | 0.9 | 9.3 | 450 | 60.1 | ○ |
| | 13 | 2.8 | 0.8 | 8.2 | 437 | 61.7 | ○ |
| | 14 | 2.5 | 0.8 | 8.5 | 431 | 64.9 | ○ |
| Comparative Examples | 15 | 7.5 | 2.3 | 6.5 | 361 | 68.0 | X |
| | 16 | 4.8 | 1.8 | 7.2 | 418 | 58.1 | X |
| | 17 | 7.7 | 2.6 | 5.5 | 393 | 67.9 | X |
| | 18 | 5.0 | 1.7 | 5.3 | 420 | 59.3 | X |
| | 19 | 8.0 | 2.4 | 5.5 | 385 | 69.3 | X |
| | 20 | 3.0 | 1.8 | 5.1 | 415 | 59.5 | X |
| | 21 | 4.8 | 1.9 | 7.3 | 408 | 65.5 | X |
| | 22 | 7.9 | 2.2 | 5.2 | 423 | 62.5 | X |
| | 23 | 6.9 | 1.4 | 6.0 | 410 | 65.9 | X |
| | 24 | 2.9 | 2.2 | 5.8 | 415 | 67.3 | X |
| | 25 | 4.7 | 2.5 | 6.5 | 392 | 66.7 | X |
| | 26 | 12.1 | 3.3 | 7. 2 | 390 | 67.2 | X |
| | 27 | 3.5 | 1.0 | 2.1 | 385 | 65.3 | X |
| | 28 | 7.0 | 2.5 | 31.2 | 460 | 63.5 | X |

INDUSTRIAL APPLICABILITY

As was described above, the present invention makes it possible to provide Cu—Mg—P—Fe alloys that have a high strength, high conductivity and superior bending workability. As a result, besides being used in electrical and electronic parts having a reduced size and weight, and IC lead frames for semiconductor devices, these alloys can be used in other applications such as IC lead frames, connectors, terminals, switches and relays requiring a high strength, high conductivity and severely stipulated bending workability.

The invention claimed is:

1. A method for manufacturing a plate of a copper alloy, said copper alloy comprising copper and alloying elements Fe in 0.01 to 1.0% by mass, P in 0.01 to 0.4% by mass, and Mg in 0.1 to 1.0% by mass, wherein said method comprises:

casting, hot rolling, cold rolling and annealing said copper alloy, wherein a time from completion of addition of the alloying elements to the copper in a melting furnace to an initiation of casting said copper alloy into an ingot is 1200 seconds or less and a cooling rate is 0.1° C./sec or greater, and wherein a time from an ejection of the ingot from a heating furnace to a completion of said hot rolling is 1200 seconds or less, wherein the plate of a copper alloy produced by said method has a ratio of an amount of Mg in an extracted residue from said plate of a copper alloy produced by said method to an Mg content in said plate of a copper alloy produced by said method of 0.60 or less; wherein said extracted residue is obtained by immersing 10 g of said plate of a copper alloy in 300 ml of a methanol solution with a 10 mass % concentration of ammonium acetate, performing constant-current electrolysis at a current density of 10 mA/cm$^2$ using said plate of a copper alloy as an anode and using platinum as a cathode to dissolve said plate of a copper alloy, and suction filtering said solution in which said plate of a copper alloy is dissolved using a polycarbonate membrane filter with an opening size of 0.1 μm to provide said extracted residue on said filter; and said amount of Mg in said extracted residue is determined by inductively coupled plasma emission sectroscopy following dissolution of said extracted residue with a solution in which aqua regia and water are mixed at a ratio of 1 to 1.

2. The method according to claim 1, wherein said method further comprises a second cold rolling after said annealing, and wherein a temperature upon completion of said hot rolling is 550° C. to 850° C., a cold rolling reduction is 70 to 98%, a mean heating rate in the annealing is set at 50° C./s or greater, a mean cooling rate following the annealing is 100° C./s or greater, and a second cold rolling reduction is 10 to 30%.

3. The method according to claim 1, wherein said alloying elements further comprise Ni or Co, or both, in a content by mass of 0.01 to 1.0%.

4. The method according to claim 1, wherein said alloying elements further comprise Zn in a content by mass of 0.005 to 3.0%.

5. The method according to claim 1, wherein said alloying elements further comprise Sn in a content by mass of 0.01 to 5.0%.

6. The method according to claim 1, wherein said alloying elements further comprise Mn or Ca, or both, at a total content of 0.0001 to 1.0% by mass.

7. The method according to claim 1, wherein said alloying elements further comprise one or more elements selected from a set of Zr, Ag, Cr, Cd, Be, Ti, Co, Ni, Au and Pt at a total content of 0.001 to 1.0% by mass.

8. The method according to claim 1, wherein said alloying elements further comprise Hf, Th, Li, Na, K, Sr, Pd, W, S, Si, C, Nb, Al, V, Y, Mo, Pb, In, Ga, Ge, As, Sb, Bi, Te, B or mischmetal so that the total content of the elements is 0.1 by mass or less.

9. The method according to claim 1, wherein the time from the completion of the addition of the alloying elements to the copper to the initiation of casting said copper alloy into an ingot is 1100 seconds or less and the time from the ejection of the ingot from the heating furnace to the completion of said hot rolling is 1100 seconds or less.

10. The method according to claim 1, wherein the plate of a copper alloy produced by said method has a mean grain size of 6.5 μm or less, wherein said grain size is measured by a crystal orientation analysis method in which an electron back scattering pattern system is mounted on a field emission scanning electron microscope, using the following expression:

$$\text{mean grain size}=(\Sigma x)/n$$

where n indicates the number of crystal grains measured and x indicates the grain size values measured, and wherein a standard deviation of the mean grain size is 1.5 μm or less, calculated using the following expression:

$$[n\Sigma x^2-(\Sigma x)^2]/[n/(n-1)^{1/2}]$$

where n indicates the number of crystal grains measured and x indicates the grain size values measured.

11. The method according to claim 1, wherein the plate of a copper alloy produced by said method has a ratio of an amount of Mg in an extracted residue from said plate of a copper alloy produced by said method to an Mg content in said plate of a copper alloy produced by said method of 0.22-0.60.

* * * * *